US010646049B2

(12) United States Patent
Sprouse, II et al.

(10) Patent No.: US 10,646,049 B2
(45) Date of Patent: May 12, 2020

(54) SEAT CUSHION

(71) Applicant: AIRHAWK INTERNATIONAL, LLC, Carlsbad, CA (US)

(72) Inventors: Anthony Eric Sprouse, II, O'Fallon, IL (US); Lars Roulund, Laguna Niguel, CA (US); Don L. Mahoney, Carlsbad, CA (US)

(73) Assignee: AIRHAWK INTERNATIONAL, LLC, Carlsbad, CA (US)

( * ) Notice: Subject to any disclaimer, the term of this patent is extended or adjusted under 35 U.S.C. 154(b) by 0 days.

(21) Appl. No.: 16/148,859

(22) Filed: Oct. 1, 2018

(65) Prior Publication Data

US 2019/0125094 A1 May 2, 2019

Related U.S. Application Data

(60) Provisional application No. 62/579,427, filed on Oct. 31, 2017.

(51) Int. Cl.
*A47C 7/02* (2006.01)
*A47C 27/08* (2006.01)

(52) U.S. Cl.
CPC ..... *A47C 27/081* (2013.01); *A47C 7/021* (2013.01); *A47C 7/029* (2018.08)

(58) Field of Classification Search
CPC ..... A47C 27/081; A47C 7/029; A47C 7/021
See application file for complete search history.

(56) References Cited

U.S. PATENT DOCUMENTS

| | | | |
|---|---|---|---|
| D179,241 | S | 11/1956 | Burton |
| D180,063 | S | 4/1957 | Burton |
| D192,421 | S | 3/1962 | Bostrom |
| 3,605,145 | A | 9/1971 | Graebe |
| D262,590 | S | 1/1982 | Trotman |
| 4,422,194 | A | 12/1983 | Viesturs |
| 4,541,136 | A | 9/1985 | Graebe |

(Continued)

FOREIGN PATENT DOCUMENTS

| | | |
|---|---|---|
| CA | 135979 | 1/2011 |
| WO | WO9829010 A1 | 7/1998 |

OTHER PUBLICATIONS http://wild-ass.com/models.php#smart.

(Continued)

*Primary Examiner* — Philip F Gabler
(74) *Attorney, Agent, or Firm* — Roeder & Broder LLP; James P. Broder

(57) ABSTRACT

A seat cushion that provides enhanced comfort and support for a user, comprises a base surface and a plurality of air cells that are positioned on and extend generally upwardly away from the base surface. The plurality of air cells include (i) a first paired air cell having a first upper surface, the entire first upper surface being angled in a first direction relative to the base surface; and (ii) a second paired air cell having a second upper surface, the entire second upper surface being angled in a second direction relative to the base surface that is different than the first direction. The second paired air cell is positioned adjacent to the first paired air cell. Additionally, the first paired air cell and the second paired air cell cooperate to provide a substantially concave combined upper surface.

24 Claims, 2 Drawing Sheets

(56) References Cited

U.S. PATENT DOCUMENTS

| | | | | |
|---|---|---|---|---|
| D294,212 | S | 2/1988 | Sias et al. | |
| 4,730,610 | A | 3/1988 | Graebe | |
| D310,610 | S | 9/1990 | Dixon | |
| 5,052,068 | A * | 10/1991 | Graebe | A47C 7/021 297/452.23 |
| 5,111,544 | A | 5/1992 | Graebe | |
| D329,566 | S | 9/1992 | Davidson, Jr. | |
| 5,152,023 | A | 10/1992 | Graebe | |
| D330,978 | S | 11/1992 | Vasquez | |
| 5,160,785 | A | 11/1992 | Davidson, Jr. | |
| D342,411 | S | 12/1993 | Graebe | |
| 5,317,773 | A | 6/1994 | Graebe | |
| 5,369,828 | A | 12/1994 | Graebe | |
| D355,558 | S | 2/1995 | Graebe | |
| 5,459,896 | A | 10/1995 | Raburn et al. | |
| 5,461,741 | A | 10/1995 | Graebe | |
| D367,199 | S | 2/1996 | Graebe | |
| 5,502,855 | A | 4/1996 | Graebe | |
| 5,561,875 | A | 10/1996 | Graebe | |
| D375,863 | S | 11/1996 | Bigolin | |
| 5,596,781 | A | 1/1997 | Graebe | |
| 5,645,314 | A | 7/1997 | Liou | |
| D386,035 | S | 11/1997 | Matsler et al. | |
| D386,036 | S | 11/1997 | Laidlaw | |
| D388,651 | S | 1/1998 | Graebe et al. | |
| D389,692 | S | 1/1998 | Graebe et al. | |
| D389,702 | S | 1/1998 | Graebe et al. | |
| D391,110 | S | 2/1998 | Graebe et al. | |
| D391,111 | S | 2/1998 | Graebe et al. | |
| D394,366 | S | 5/1998 | Graebe et al. | |
| D394,578 | S | 5/1998 | Raburn | |
| 5,845,352 | A | 12/1998 | Matsler et al. | |
| D405,636 | S | 2/1999 | Stewart | |
| D416,143 | S | 11/1999 | Ragan | |
| 6,189,168 | B1 | 2/2001 | Graebe | |
| D439,098 | S | 3/2001 | Matsler et al. | |
| D449,170 | S | 10/2001 | Kim | |
| D456,197 | S | 4/2002 | McClure | |
| D463,701 | S | 10/2002 | Borcherding et al. | |
| 6,510,573 | B1 | 1/2003 | Grabe | |
| 6,623,080 | B2 * | 9/2003 | Clapper | A47C 4/54 297/452.41 |
| D487,372 | S | 3/2004 | Ku | |
| 6,715,171 | B2 | 4/2004 | Grabe | |
| D497,761 | S | 11/2004 | Martin | |
| 6,901,617 | B2 | 6/2005 | Sprouse, II et al. | |
| D508,812 | S | 8/2005 | Kuo | |
| D529,326 | S | 10/2006 | Martin et al. | |
| 7,350,251 | B2 | 4/2008 | Fraser et al. | |
| 7,373,678 | B2 | 5/2008 | Hetzel et al. | |
| 7,424,761 | B1 | 9/2008 | Graebe | |
| D617,131 | S | 6/2010 | Sprouse, II | |
| D643,665 | S | 8/2011 | Goeckel et al. | |
| D645,284 | S | 9/2011 | Goeckel et al. | |
| D645,285 | S | 9/2011 | Goeckel et al. | |
| D646,100 | S | 10/2011 | Klotz | |
| D646,101 | S | 10/2011 | Goeckel et al. | |
| D647,343 | S | 10/2011 | Goeckel et al. | |
| D647,344 | S | 10/2011 | Goeckel et al. | |
| D647,345 | S | 10/2011 | Goeckel et al. | |
| D647,346 | S | 10/2011 | Klotz | |
| D647,347 | S | 10/2011 | Klotz | |
| D647,348 | S | 10/2011 | Klotz | |
| D647,349 | S | 10/2011 | Klotz | |
| D648,168 | S | 11/2011 | Goeckel et al. | |
| D648,169 | S | 11/2011 | Sprouse, II | |
| D650,214 | S | 12/2011 | Klotz | |
| D658,396 | S | 5/2012 | Sprouse, II | |
| D672,569 | S | 12/2012 | Sprouse, II | |
| D673,785 | S | 1/2013 | Sprouse, II | |
| D707,059 | S | 6/2014 | Huang | |
| D738,644 | S | 9/2015 | Reynolds | |
| D751,322 | S | 3/2016 | Reynolds | |
| D758,101 | S | 6/2016 | Mason | |
| D758,102 | S | 6/2016 | Mason | |
| D758,103 | S | 6/2016 | Mason | |
| D781,615 | S | 3/2017 | Parman | |
| D781,616 | S | 3/2017 | Parman | |
| D785,118 | S | 4/2017 | Castillo | |
| D798,634 | S | 10/2017 | Sprouse, II et al. | |
| 2005/0017565 | A1 | 1/2005 | Sprouse, II | |
| 2005/0102756 | A1 | 5/2005 | Martin | |
| 2005/0120483 | A1 | 6/2005 | Clapper | |
| 2005/0121953 | A1 * | 6/2005 | Sprouse, II | B62J 1/12 297/199 |
| 2005/0151410 | A1 | 7/2005 | Sprouse, II | |
| 2008/0079306 | A1 | 4/2008 | Whelan et al. | |
| 2012/0292958 | A1 * | 11/2012 | Sprouse, II | B60N 2/5664 297/200 |
| 2013/0055503 | A1 | 3/2013 | Huang | |
| 2019/0125094 | A1 * | 5/2019 | Sprouse, II | A47C 27/081 |

OTHER PUBLICATIONS

*Airhawk International, LLC* v. *TheRealCraigJ, LLC* dba Wild Ass, et al, Complaint for Patent Infringement, False Advertising, Tortious Interference, and Unfair Competition, Filed in the U.S. District Court, Central District of California, Southern Division, Case No. 16-cv-00624, Apr. 4, 2016.

The ROHO Store Office Seating cushions shown and described in ROHO website. [Retrieved Aug. 23, 2016]. Retrieved from Internet <URL: https://roho.com/category/store-products/comfort-products/office/>.

The ROHO Store Wheelchair Cushions shown and described in ROHO website. [Retrieved Aug. 23, 2016]. Retrieved from Internet <URL: https://roho.com/category/store-products/comfort-products/wheelchair-cushons/>.

The ROHO Store Specialty Cushioning Products shown and described in ROHO website. [Retrieved Aug. 23, 2016]. Retrieved from Internet <URL: https://roho.com/category/store-products/comfort-products/specialty-cushioning-products/>.

Airhawk Office Chair Seat Cushion, announced unknown, [online], [site visited May 7, 2016]. Available from Internet, <URL:https://airhawk.net/product-category/airhawk-office-chair-seat-cushion/>.

* cited by examiner

SEAT CUSHION

RELATED APPLICATION

This application claims priority on U.S. Provisional Application Ser. No. 62/579,427, filed on Oct. 31, 2017, and entitled "SEAT CUSHION". As far as permitted, the contents of U.S. Provisional Application Ser. No. 62/579,427 are incorporated in their entirety herein by reference.

BACKGROUND

Office workers can often find themselves seated in an office chair for many hours continuously throughout a typical work day. A common problem for individuals who spend extended time seated in an office chair is that the user can experience soreness in the core and/or lower portions of the body such as areas of the buttocks, legs and back. In some extreme instances, the user can also experience numbness or loss of feeling in the buttocks, particularly the ischial areas, and in the upper legs or thighs. Thus, it is desired to have an office chair and/or a seat cushion usable with an office chair that provides increased comfort and optimal support under the ischial areas over multi-hour, e.g., three-hour to four-hour, time increments. Additionally, it is desired for users who are seated in an office chair substantially continuously for many hours each day to have an office chair and/or a seat cushion that decreases fatigue in the buttocks, legs and back of the user, as well as effectively promoting blood flow to the lower extremities.

SUMMARY

The present invention is directed toward a seat cushion that provides enhanced comfort and support for the user, who may be using the seat cushion substantially continuously for many hours a day. In particular, in various embodiments, the seat cushion includes a base surface and a plurality of air cells that are positioned on and extend generally upwardly away from the base surface. The plurality of air cells include (i) a first paired air cell having a first upper surface, the entire first upper surface being angled in a first direction relative to the base surface; and (ii) a second paired air cell having a second upper surface, the entire second upper surface being angled in a second direction relative to the base surface that is different than the first direction. The second paired air cell is positioned adjacent to the first paired air cell. Additionally, the first paired air cell and the second paired air cell cooperate to provide a substantially concave combined upper surface.

In some embodiments, the plurality of air cells form a substantially U-shaped array. Further, in certain such embodiments, the plurality of air cells includes (i) a first row of air cells that are configured relative to one another to extend along an outer edge of the seat cushion, and adjacent to a first lateral side, a rear side and a second lateral side of the seat cushion in a curved, substantially U-shaped design; and (ii) a second row of air cells that is positioned substantially adjacent to the first row of air cells, and that are configured relative to one another to include a curved substantially U-shaped design.

Additionally, in certain embodiments, the base surface includes a centerline that extends from a front side to a rear side of the seat cushion. In such embodiments, the seat cushion further includes an air gap that extends along the centerline; and none of the plurality of air cells are positioned within the air gap. In some embodiments, the air gap can divide the plurality of air cells into two substantially symmetrical halves. Further, in certain embodiments, adjacent to the front side of the seat cushion the plurality of air cells includes a first air cell and a second air cell that are adjacent to one another on either side of the centerline. In such embodiments, the air gap includes an air gap width that extends between the first air cell and the second air cell. Moreover, in such embodiments, inner edges of each of the first air cell and the second air cell are angled relative to one another such that the air gap width is greater toward a front of the first air cell and the second air cell than toward a rear of the first air cell and the second air cell.

Further, in some embodiments, the base surface includes a front side and a rear side, and the air cells substantially adjacent to the front side are shorter than the air cells substantially adjacent to the rear side.

Additionally, in certain embodiments, the seat cushion includes a front side, a rear side, a first lateral side, and an opposed second lateral side; and the base surface includes a centerline that extends from the front side to the rear side of the seat cushion. In some such embodiments, in rows of air cells that extend across the seat cushion from the first lateral side to the second lateral side, the air cells adjacent to the first lateral side and the second lateral side have a smaller cross-sectional area than the air cells adjacent to the centerline.

In some embodiments, the seat cushion is configured to be selectively positioned on a seating surface of a seating apparatus. Additionally, or in the alternative, the seat cushion can be configured to be integrated within and form a part of a seating apparatus.

In another application, the present invention is further directed toward a seat cushion including a base surface; and a plurality of air cells that are positioned on and extend generally upwardly away from the base surface, the plurality of air cells including (i) a first row of air cells that are configured relative to one another to extend along an outer edge of the seat cushion, and adjacent to a first lateral side, a rear side and a second lateral side of the seat cushion in a curved, substantially U-shaped design; and (ii) a second row of air cells that is positioned substantially adjacent to the first row of air cells, and that are configured relative to one another to include a curved substantially U-shaped design.

Additionally, in still another application, the present invention is directed toward a seat cushion including a base surface including a centerline that extends from the front side to the rear side of the seat cushion; a plurality of air cells that are positioned on and extend generally upwardly away from the base surface, adjacent to the front side of the seat cushion the plurality of air cells including a first air cell and a second air cell that are adjacent to one another on either side of the centerline; and an air gap that extends along the centerline, none of the plurality of air cells being positioned within the air gap; the air gap including an air gap width that extends between the first air cell and the second air cell, wherein inner edges of each of the first air cell and the second air cell are angled relative to one another such that the air gap width is greater toward a front of the first air cell and the second air cell than toward a rear of the first air cell and the second air cell.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a seat cushion that is usable with any suitable type of seating apparatus, e.g., an office chair, to provide a more comfortable and supportive seating situation for the user. More particularly, as provided herein, the seat cushion is configured to provide enhanced comfort and support, as well as decreased fatigue, in the buttocks, legs and back of the user, especially when the seat cushion is used by a user over multi-hour time increments.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar nomenclature and/or reference indicators will be used throughout the drawings and the following detailed description to refer to the same or like parts.

In the interest of clarity, not all of the routine features of the implementations described herein are shown and described. It will, of course, be appreciated that in the development of any such actual implementations, numerous implementation-specific decisions must be made in order to achieve the developer's specific goals, such as compliance with application-related and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
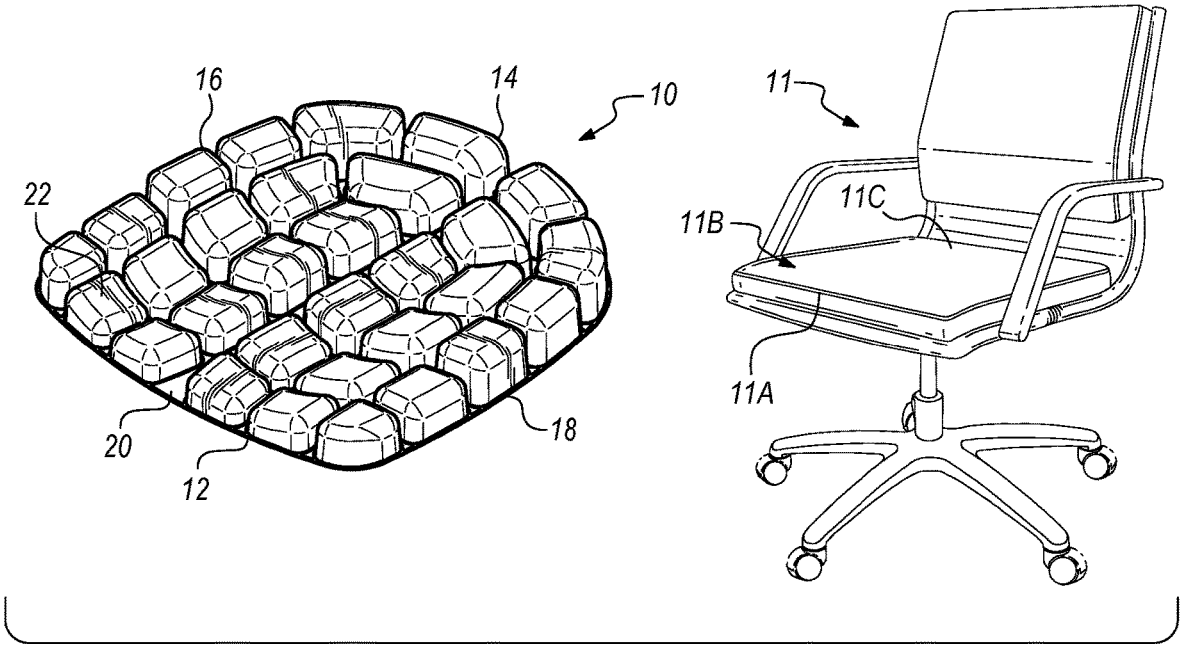
FIG. 1A is a perspective view of a seating apparatus and an embodiment of a seat cushion having features of the present invention that is usable with the seating apparatus.

FIG. 1A is a perspective view of an embodiment of a seat cushion 10 having features of the present invention. In various embodiments, the seat cushion 10 is configured to be utilized with a seating apparatus 11, which can be any suitable types of chairs, e.g., office chairs, or any other type of chair, stool, or other seating apparatus. Additionally, or in the alternative, in certain embodiments, the seat cushion 10 can be integrated within the seating apparatus 11, thus forming a part of the seating apparatus 11. Further, although individual usage of the seat cushion 10 can vary, the seat cushion 10 is designed to be usable on a daily basis and can typically be used for up to at least six-to-eight hours per day (typically in three-hour to four-hour time increments).

The design of the seat cushion 10 can be varied to suit the specific requirements of the seating apparatus 11 with which the seat cushion 10 is used and/or to more effectively suit the comfort of the user of the seat cushion 10. As illustrated in FIG. 1A, in certain embodiments, the seat cushion 10 includes a front side 12 (also sometimes referred to as a "front edge"), a rear side 14 (also sometimes referred to as a "rear edge"), a first lateral side 16 (also sometimes referred to as a "first lateral edge") that extends from the front side 12 to the rear side 14, an opposed second lateral side 18 (also sometimes referred to as a "second lateral edge") that extends from the front side 12 to the rear side 14, a base surface 20, and a plurality of air cells 22 that are positioned on and extend generally upwardly away from the base surface 20. Alternatively, the seat cushion 10 can have a different design than what is specifically illustrated in FIG. 1A.

Additionally, as utilized with the seating apparatus 11 such as an office chair, the seat cushion 10 is configured such that when the seat cushion 10 is positioned on the seating apparatus 11, the front side 12 of the seat cushion 10 is positioned near a front side 11A of a seating surface 11B of the seating apparatus 11, the rear side 14 of the seat cushion 10 is positioned near a rear side 11C of the seating surface 11B of the seating apparatus 11, and the base surface 20 is positioned on the seating surface 11B of the seating apparatus 11.

As an overview, the seat cushion 10 is designed to provide improved and enhanced comfort and support for the user, who often may have to be continuously seated on the seat cushion 10, e.g., during work, for long periods of time. More specifically, as described in detail herein, the plurality of air cells 22 are specifically designed, sized, shaped, positioned and oriented relative to one another to provide improved comfort and support for the user. Additionally, the cellular structure of the plurality of air cells 22, as well as the cellular deformation that occurs during use of the seat cushion 10 encourage multiple load locations of the human interface, i.e. the interface between the seat cushion 10 and the user, and enhance compliance to the ever-changing and in-use human interface.

In certain embodiments, the seat cushion 10 is designed such that at least some of the air cells 22 are appropriately positioned under the ischial areas of the user. Additionally, in such embodiments, the air cells 22 are designed to distribute supportive force generally evenly across its surface. Thus, the seat cushion 10 is configured to exert a substantially uniform force or pressure on the surface area of the body, i.e. the portion of the body of the user, that is directly supported on the seat cushion 10. Accordingly, the user does not feel discomfort from seat pressure, for example under the ischial area, or the lower portion of the hip bone, affording a more comfortable seated position over long periods of time. The air cell 22 design can also relieve pressure on nerves that can otherwise result in tingling and numbness in the legs and hips of the user.

The design, size, shape, positioning and orientation of the plurality of air cells 22 can be varied. For example, as illustrated in the non-exclusive embodiment shown in FIG. 1A, the air cells 22 are sized, shaped, positioned and oriented to provide a curved or rounded, substantially U-shaped or horseshoe-shaped array. Stated in another manner, in such embodiment, the plurality of air cells 22 are configured relative to one another so as to provide a curved or rounded, substantially U-shaped or horseshoe-shaped array. Additionally, as provided herein, the individual air cells 22 can be provided in various shapes and sizes. Alternatively, the design, size, shape, positioning and orientation of the air cells 22 can be different than what is shown in the Figures and what is specifically described herein.

Additionally, the seat cushion 10 can include any desired number of air cells 22. For example, as illustrated in FIG.

1A, the seat cushion 10 can be designed to include thirty individual air cells 22. Alternatively, the seat cushion 10 can be designed to include greater than thirty or less than thirty individual air cells 22.

Further, in certain embodiments, some or all of the air cells 22 can be interconnected with one another, i.e. with airflow directly between the interconnected air cells 22 (from one to another), to provide more balanced support throughout the seat cushion 10. Stated in another manner, the air transfer and/or air communication between air cells 22 that are interconnected with one another (i.e. with direct airflow or air transfer from one air cell 22 to one or more other air cells 22) enhances force distribution for the user, and manages static and dynamic body adjustments and differences to accommodate surface interfacial deficiencies. Alternatively, each of the plurality of air cells 22 can be provided independently from each of the other air cells 22. Still further, in some embodiments, the air pressure within the air cells 22 can be selectively controlled by the user to thereby control the overall support for the user.

As noted herein, the seat cushion 10, e.g., the design of the array of air cells 22, is configured to provide certain advantages such as decreasing fatigue in the buttocks, legs and back of the user; and promoting enhanced blood flow to the lower extremities of the user. Additionally, the particular design, structure and placement of the air cells 22 implements off-loading opportunities in the perineum and coccyx areas, as well as providing reduced loading in the thigh areas. Moreover, the seat cushion 10 can be utilized to accommodate poor chair design by adding a cushioning layer that is able to adapt to the specific shape of the user.

The air cells 22 can be formed from any suitable materials. For example, in certain non-exclusive alternative embodiments, the air cells 22 can be formed from polyether polyurethane, dip-molded neoprene, a vacuum-molded plastic material, and/or any combination or composite thereof. It is appreciated that such materials can promote the inherent liquidity that they offer, as well as reducing interface surface friction. Alternatively, the air cells 22 can be formed from another suitable material or combination of materials.

Figure 1B:
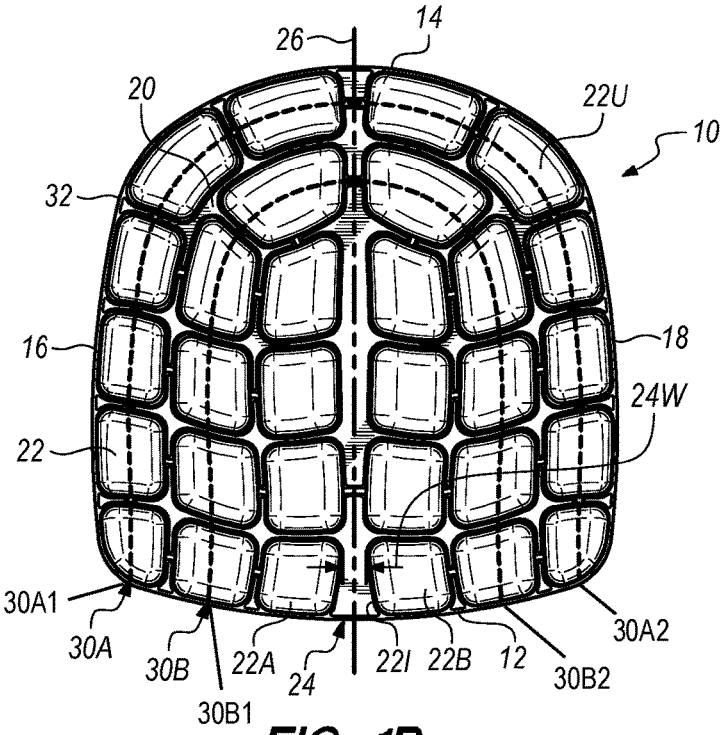
FIG. 1B is a top view of the seat cushion illustrated in FIG. 1A.

FIG. 1B is a top view of the seat cushion 10 illustrated in FIG. 1A. FIG. 1B again illustrates that the seat cushion 10 includes the front side 12, the rear side 14, the first lateral side 16, the opposed second lateral side 18, the base surface 20, and the plurality of air cells 22 that are positioned on and extend generally upwardly away from the base surface 20.

As noted above, in certain embodiments, the seat cushion 10 can be configured such that the plurality of air cells 22 provide an overall curved or rounded, substantially U-shaped or horse-shaped design. More specifically, as shown more clearly in FIG. 1B, the air cells 22 can be said to include (i) a first (outer) row of air cells 30A (illustrated with a dashed line) that are designed (i.e. sized and shaped) and oriented, and/or are configured relative to one another, to extend along an outer edge 32 of the seat cushion 10, and adjacent to the first lateral side 16, the rear side 14 and the second lateral side 18 in a curved or rounded, substantially U-shaped or horse-shaped design, i.e. with one of the plurality of air cells 22 at a first end 30A1 of the first row of air cells 30A and one of the plurality of air cells 22 at an opposed second end 30A2 of the first row of air cells 30A each being positioned immediately adjacent to the front side 12 of the seat cushion 10; and (ii) a second row of air cells 30B (illustrated with a dashed line) that is positioned substantially adjacent to the first row of air cells 30A, and that also are designed (i.e. sized and shaped) and oriented, and/or are configured relative to one another, to include a curved or rounded, substantially U-shaped or horse-shaped design, i.e. with one of the plurality of air cells 22 at a first end 30B1 of the second row of air cells 30B and one of the plurality of air cells 22 at an opposed second end 30B2 of the second row of air cells 30B each being positioned immediately adjacent to the front side 12 of the seat cushion 10. Further, in some embodiments, as shown in FIG. 1B, the second row of air cells 30B can be positioned spaced apart from the first row of air cells 30A.

Additionally, FIG. 1B further illustrates an air gap 24 that extends substantially along a centerline 26 of the base surface 20 from the front side 12 to the rear side 14. As shown, the air gap 24 is defined by spacing between adjacent air cells on either side of the centerline 26 of the base surface 20, with no air cells 22 being positioned within the air gap 24. The air gap 24 effectively separates the plurality of air cells 22 into two equal groups, with one group on either side of the air gap 24. Stated in another manner, the plurality of air cells 22 are divided into two symmetrical halves by the air gap 24 that extends along the centerline 26 therebetween, e.g., with fifteen air cells 22 on each side. The air gap 24 allows for improved air flow through the centerline 26, which provides desired cooling for the seated user.

Further, as shown in FIG. 1B, a width 24W of the air gap 24 is not necessarily consistent for the full length of the air gap 24 from the front side 12 to the rear side 14. More specifically, in certain embodiments, as illustrated, adjacent air cells 22 along the front side 12 of the seat cushion 10 on either side of the centerline 26 (and on either side of the air gap 24) can have inner edges 22I (i.e. the edges that face the air gap 24) that are angled away from one another from back to front so that the air gap width 24W is larger toward the front side 12 of the seat cushion 10. Stated in another manner, adjacent to the front side 12 of the seat cushion 10, the seat cushion 10 includes a first air cell 22A and a second air cell 22B that are adjacent to one another on either side of (or across) the centerline 26. The inner edges 22I of each of the first air cell 22A and the second air cell 22B are angled relative to one another from the front to the back such that the air gap width 24W is greater toward the front of the first air cell 22A and the second air cell 22B than toward the rear of the first air cell 22A and the second air cell 22B.

Additionally, as provided herein, the air cells 22 can be designed (e.g., sized and shaped) in various manners to provide certain benefits to the user. For example, as shown, some of the air cells 22 can be substantially square-shaped and/or rectangle-shaped, while other air cells 22 can be at least somewhat trapezoid-shaped. Additionally, the air cells 22 can be designed to have an upper surface 22U that can include a number of fins and/or can be angled or rounded in shape. Alternatively, the air cells 22 can be designed to have different shapes than what are specifically illustrated in the Figures.

Further, as shown in FIG. 1B, in certain embodiments, the size and shape of each of the various air cells 22 (or at least some of the air cells 22) can differ from one another so as to more adequately bolster certain areas of the seat cushion 10 for providing improved lateral support for the user. For example, as shown in FIG. 1B, in rows of air cells 22 that extend directly across the seat cushion 10 from the first lateral side 16 to the second lateral side 18, the seat cushion 10 can include air cells 22 toward and/or adjacent to the first lateral side 16 and the second lateral side 18 that have a smaller cross-sectional area (i.e. in the lateral or horizontal direction, parallel to the base surface 20) than the air cells 22 nearer and/or adjacent to the centerline 26. Additionally, the size and shape of the plurality of air cells 22 can be configured to provide decreased pressure along the perineum. Further aspects of the size and shape of the air cells 22 can be seen more clearly with reference to FIGS. 1C and 1D, as discussed in greater detail herein below.

Figure 1C:
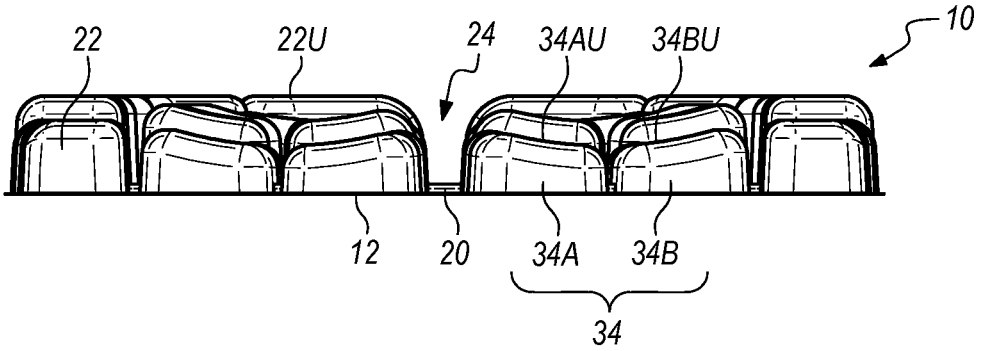
FIG. 1C is a front view of the seat cushion illustrated in FIG. 1A.

FIG. 1C is a front end view of the seat cushion 10 illustrated in FIG. 1A. As noted above, FIG. 1C illustrates certain aspects of the design of the plurality of air cells 22 that are included within certain embodiments of the seat cushion 10. For example, as shown in FIG. 1C (and being more clearly visible in FIG. 1D), the seat cushion 10 can be designed to have air cells 22 of multiple different heights. Stated in another manner, the air cells 22 can be designed to extend a different amount upwardly away from the base surface 20. In this embodiment, the air cells 22 toward the front side 12 can be somewhat shorter, with the lowered front bolstering to reduce loading at the gluteal fold and the back of the thighs of the user. Conversely, the air cells toward the rear side 14 (illustrated in FIG. 1A) can be somewhat taller, with the raised rear bolstering for increased support for the user.

Additionally, as illustrated, the air cells 22 can have and/or incorporate contoured shapes to match body ingress. As can be seen in FIG. 1C, some of the air cells 22 can be designed to include an upper surface 22U that is substantially flat or parallel relative to the base surface 20.

However, others of the air cells 22 can have an upper surface 22U that is angled (non-parallel) relative to the base surface 20. For example, some of the air cells 22, e.g., nearer to the air gap 24, can include an upper surface 22U that is angled across an entirety of the upper surface 22U in a generally downward direction toward an adjacent air cell 22. With such design, the adjacent air cells 22 can cooperate to provide a substantially concave-shaped upper surface for the user between the two air cells 22. More specifically, in such embodiments, the plurality of air cells 22 can include one or more pairs of air cells 34, with each pair of air cells 34 including (i) a first paired air cell 34A having a first upper surface 34AU, wherein the entire first upper surface 34AU is angled in a first direction relative to the base surface 20; and (ii) a second paired air cell 34B having a second upper surface 34BU, wherein the entire second upper surface 34BU is angled in a second direction relative to the base surface 20 that is different than the first direction; wherein the second paired air cell 34B is positioned adjacent to the first paired air cell 34A, and wherein the first paired air cell 34A and the second paired air cell 34B cooperate to provide a substantially concave combined upper surface.

Alternatively, in some embodiments, one or more air cells 22 can be angled in a generally upward direction toward an adjacent air cell 22 to provide a substantially convex-shaped upper surface for the user between the two air cells 22. Still alternatively, single air cells 22 can also be designed to include a generally concave-shaped or convex-shaped upper surface 22.

Further, as shown, the air cells 22 can be designed to include rounded edges to inhibit interfacial sensation.

Additionally, as noted above, the design, shape, positioning and orientation of the air cells 22 can be configured to provide desired perineum relief for the user.

Figure 1D:
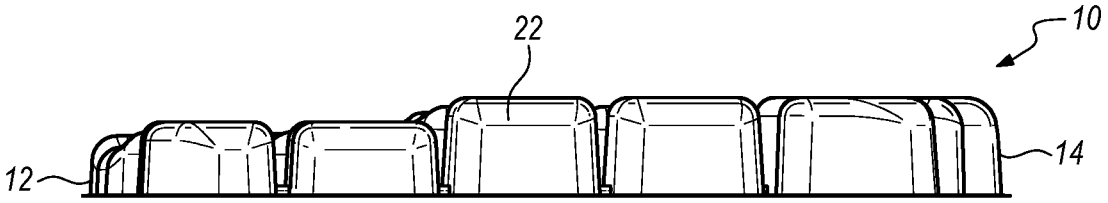
FIG. 1D is a side view of the seat cushion illustrated in FIG. 1A.

FIG. 1D is a side view of the seat cushion 10 illustrated in FIG. 1A. In particular, FIG. 1D also illustrates certain aspects of the design of the plurality of air cells 22 that are included within certain embodiments of the seat cushion 10. For example, FIG. 1D more clearly illustrates that, in this embodiment, the air cells 22 toward the front side 12 are generally shorter than the air cells 22 toward the rear side 14 of the seat cushion 10.

As provided herein, the design of the array of air cells 22 in the seat cushion 10 can be configured to provide enhanced air flow management, e.g., in, around and through the air gap 24. Additionally, the air cells 22 can further provide directed lateral air movement for stability, as well as controlled air flow to inhibit a water-like sensation for the user.

It is understood that although a number of different embodiments of the seat cushion 10 have been illustrated and described herein, one or more features of any one embodiment can be combined with one or more features of one or more of the other embodiments, provided that such combination satisfies the intent of the present invention.

While a number of exemplary aspects and embodiments of the seat cushion 10 have been shown and disclosed herein above, those of skill in the art will recognize certain modifications, permutations, additions and sub-combinations thereof. It is therefore intended that the seat cushion shall be interpreted to include all such modifications, permutations, additions and sub-combinations as are within their true spirit and scope, and no limitations are intended to the details of construction or design herein shown.

What is claimed is:

1. A seat cushion comprising:

a base surface; and a plurality of air cells that are positioned on and extend generally upwardly away from the base surface, the plurality of air cells including a first paired air cell having a first upper surface, and a second paired air cell having a second upper surface, the second paired air cell being positioned directly adjacent to the first paired air cell; the entire first upper surface being angled downwardly in a first direction toward the second paired air cell and relative to the base surface such that the entire first upper surface is non-parallel to the base surface; and the entire second upper surface being angled downwardly in a second direction toward the first paired air cell and relative to the base surface such that the entire second upper surface is non-parallel to the base surface, the second direction being different than the first direction so that the second upper surface and the first upper surface form a substantially concave combined upper surface.

2. The seat cushion of claim 1 wherein the plurality of air cells form a substantially U-shaped array.

3. The seat cushion of claim 2 wherein the plurality of air cells includes (i) a first row of air cells that are configured relative to one another to extend along an outer edge of the seat cushion, and adjacent to a first lateral edge, a rear edge and a second lateral edge of the seat cushion in a curved, substantially U-shaped design; and (ii) a second row of air cells that is positioned substantially adjacent to the first row of air cells, and that are configured relative to one another to include a curved substantially U-shaped design.

4. The seat cushion of claim 1 wherein the base surface includes a centerline that extends from a front edge to a rear edge of the seat cushion; wherein the seat cushion further includes an air gap that extends along the centerline; and wherein none of the plurality of air cells are positioned within the air gap.

5. The seat cushion of claim 4 wherein the air gap divides the plurality of air cells into two substantially symmetrical halves.

6. The seat cushion of claim 4 wherein adjacent to the front edge of the seat cushion the plurality of air cells includes a first air cell and a second air cell that are adjacent to one another on either side of the centerline; wherein the air gap includes an air gap width that extends between the first air cell and the second air cell; and wherein inner edges of each of the first air cell and the second air cell are angled relative to one another such that the air gap width is greater toward a front of the first air cell and the second air cell than toward a rear of the first air cell and the second air cell.

7. The seat cushion of claim 1 wherein the base surface includes a front edge and a rear edge, and wherein the air cells substantially adjacent to the front edge are shorter than the air cells substantially adjacent to the rear edge.

8. The seat cushion of claim 1 wherein the seat cushion includes a front edge, a rear edge, a first lateral edge, and an opposed second lateral edge; wherein the base surface includes a centerline that extends from the front edge to the rear edge of the seat cushion; and wherein in rows of air cells that extend across the seat cushion from the first lateral edge to the second lateral edge, the air cells adjacent to the first lateral edge and the second lateral edge have a smaller cross-sectional area than the air cells adjacent to the centerline.

9. The seat cushion of claim 1 wherein the seat cushion is configured to be selectively positioned on a seating surface of a seating apparatus.

10. The seat cushion of claim 1 wherein the seat cushion is configured to be integrated within and forms a part of a seating apparatus.

11. A seat cushion including and an outer edge, the seat cushion comprising:

a front edge;

a rear edge;

a first lateral edge that extends between the front edge and the rear edge;

a second lateral edge that extends between the front edge and the rear edge;

a base surface; and a plurality of air cells that are positioned on and extend generally upwardly away from the base surface, the plurality of air cells including (i) a first row of air cells that are configured relative to one another to extend along the outer edge of the seat cushion, and adjacent to the first lateral edge, the rear edge and the second lateral edge of the seat cushion in a curved, substantially U-shaped design; and (ii) a second row of air cells that is positioned substantially adjacent to the first row of air cells, and that are configured relative to one another to include a curved substantially U-shaped design;

wherein one of the plurality of air cells at a first end of the first row of air cells and one of the plurality of air cells at an opposed second end of the first row of air cells are each positioned immediately adjacent to the front edge of the seat cushion; and wherein one of the plurality of air cells at a first end of the second row of air cells and one of the plurality of air cells at an opposed second end of the second row of air cells are each positioned immediately adjacent to the front edge of the seat cushion.

12. The seat cushion of claim 11 wherein the first row of air cells is spaced apart from the second row of air cells.

13. The seat cushion of claim 11 wherein the base surface includes a centerline that extends from the front edge to the rear edge of the seat cushion; wherein the seat cushion further includes an air gap that extends along the centerline; and wherein none of the plurality of air cells are positioned within the air gap.

14. The seat cushion of claim 13 wherein adjacent to the front edge of the seat cushion the plurality of air cells includes a first air cell and a second air cell that are adjacent to one another on either side of the centerline; wherein the air gap includes an air gap width that extends between the first air cell and the second air cell; and wherein inner edges of each of the first air cell and the second air cell are angled relative to one another such that the air gap width is greater toward a front of the first air cell and the second air cell than toward a rear of the first air cell and the second air cell.

15. The seat cushion of claim 11 wherein the air cells substantially adjacent to the front edge are shorter than the air cells substantially adjacent to the rear edge.

16. The seat cushion of claim 11 wherein the base surface includes a centerline that extends from the front edge to the rear edge of the seat cushion, and wherein in rows of air cells that extend across the seat cushion from the first lateral edge to the second lateral edge, the air cells adjacent to the first lateral edge and the second lateral edge have a smaller cross-sectional area than the air cells adjacent to the centerline.

17. The seat cushion of claim 11 wherein the seat cushion is configured to be selectively positioned on a seating surface of a seating apparatus.

18. The seat cushion of claim 11 wherein the seat cushion is configured to be integrated within and forms a part of a seating apparatus.

19. A seat cushion including a front edge and a rear edge, the seat cushion comprising:

a base surface including a centerline that extends from the front edge to the rear edge of the seat cushion;

a plurality of air cells that are positioned on and extend generally upwardly away from the base surface, adjacent to the front edge of the seat cushion the plurality of air cells including a first air cell and a second air cell that are adjacent to one another on either side of the centerline; and an air gap that extends along the centerline, none of the plurality of air cells being positioned within the air gap; the air gap including an air gap width that extends between the first air cell and the second air cell, wherein inner edges of each of the first air cell and the second air cell are gradually angled away from one another along an entire length of the inner edges from a rear to a front of the first air cell and the second air cell such that the air gap width is greater toward the front of the first air cell and the second air cell than toward the rear of the first air cell and the second air cell.

20. The seat cushion of claim 19 wherein the plurality of air cells form a substantially U-shaped array.

21. The seat cushion of claim 19 wherein the air cells substantially adjacent to the front edge are shorter than the air cells substantially adjacent to the rear edge.

22. The seat cushion of claim 19 wherein in rows of air cells that extend across the seat cushion from a first lateral edge to a second lateral edge, the air cells adjacent to the first lateral edge and the second lateral edge have a smaller cross-sectional area than the air cells adjacent to the centerline.

23. The seat cushion of claim 19 wherein the seat cushion is configured to be selectively positioned on a seating surface of a seating apparatus.

24. The seat cushion of claim 19 wherein the seat cushion is configured to be integrated within and forms a part of a seating apparatus.

* * * * *